United States Patent [19]

De Boer

[11] 4,345,688

[45] Aug. 24, 1982

[54] TOOL HOLDER DEVICE

[76] Inventor: Albert De Boer, 18851 Wildwood Ave., Lansing, Ill. 60438

[21] Appl. No.: 169,938

[22] Filed: Jul. 18, 1980

[51] Int. Cl.[3] ..... A47F 5/01

[52] U.S. Cl. ..... 211/60 T; 211/106

[58] Field of Search ..... 211/60 T, 60 R, 106, 211/88, 59.1, 69, 181, 57.1, 41, 86, 99, 87, 104

[56] References Cited

U.S. PATENT DOCUMENTS

| | | | |
|---|---|---|---|
| 2,815,863 | 12/1957 | Larson | 211/60 T |
| 2,818,980 | 1/1958 | Losching | 211/181 X |
| 2,831,598 | 4/1958 | Slavsky et al. | 211/88 X |
| 3,268,087 | 8/1966 | Kramer | 211/60 R X |
| 4,234,094 | 11/1980 | Jorgersen | 211/88 |

FOREIGN PATENT DOCUMENTS

| | | | |
|---|---|---|---|
| 2549554 | 5/1977 | Fed. Rep. of Germany | 211/60 T |
| 2405049 | 6/1979 | France | 211/59.1 |

*Primary Examiner*—Roy D. Frazier
*Assistant Examiner*—Robert W. Gibson, Jr.
*Attorney, Agent, or Firm*—Hill, Van Santen, Steadman, Chiara & Simpson

[57] ABSTRACT

A compact tool holder for storage of hand tools in an organized, accessible and compact manner. The holder includes a wire mesh body with a top face to support most tools in the cross wires of the mesh with portions of the tools extending downward through openings in the mesh for stabilizing the tools in an upright manner. A hanger assembly is provided to support larger tools from hooks extending from a front face of the holder body and a support plate is provided to support items which would otherwise fall through the mesh openings.

8 Claims, 4 Drawing Figures

FIG. 1
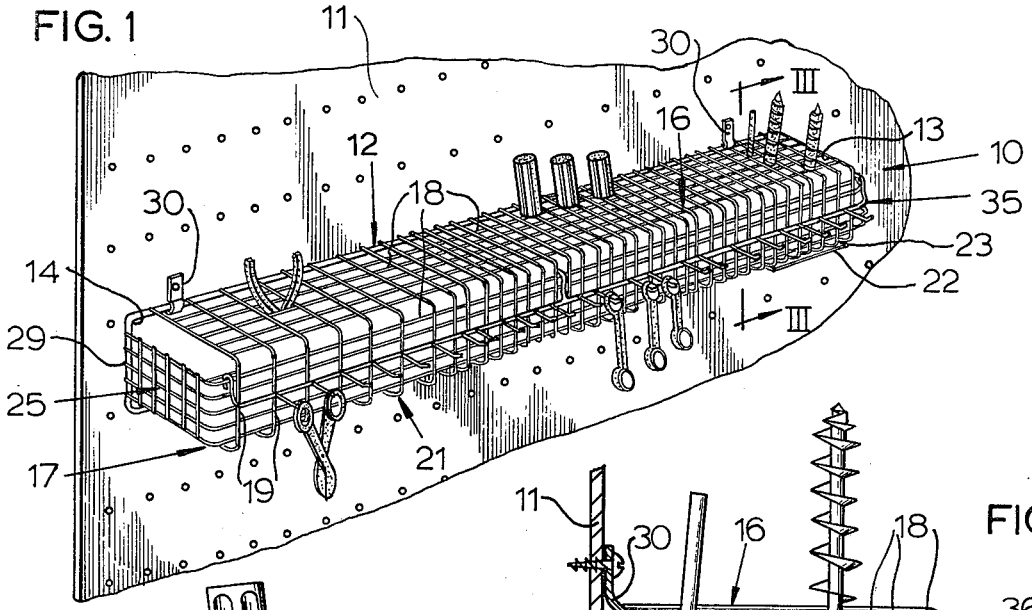
FIG. 3
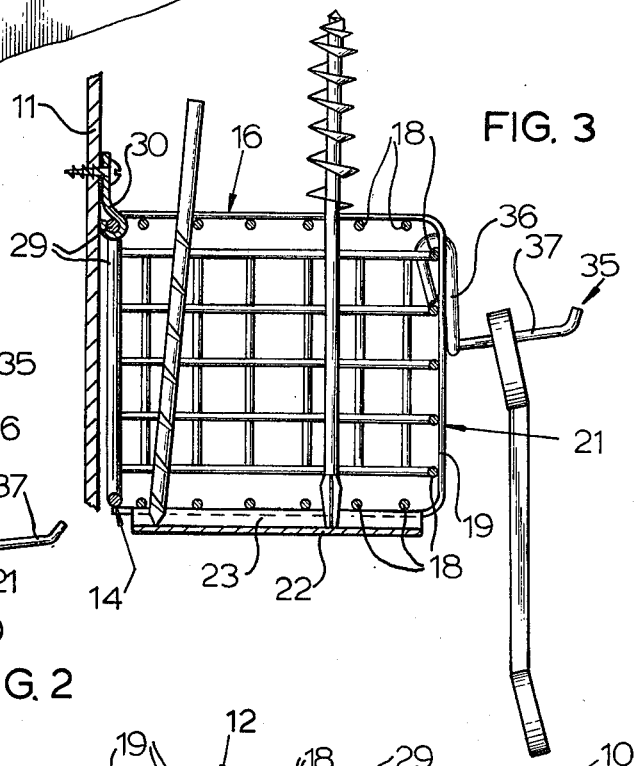
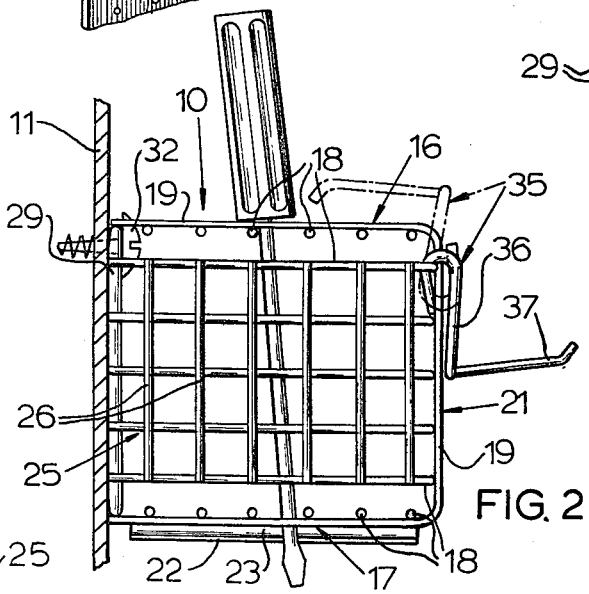
FIG. 2
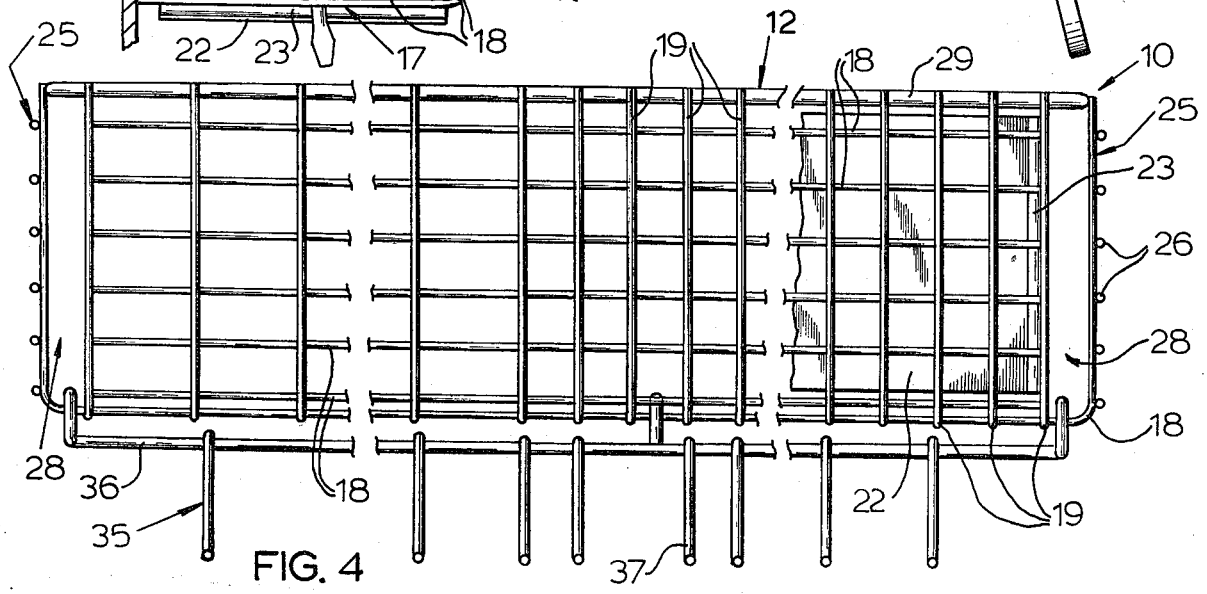
FIG. 4

TOOL HOLDER DEVICE

BACKGROUND OF THE INVENTION

The field of this invention is directed to a tool storage device and more particularly to a compact tool storage rack which can hold a wide variety of hand tools in a minimum of space yet provide full accessibility thereto.

Tool holders commonly utilized are incapable of supporting a full complement of tools in a readily accessible array as is normally needed in most workshops. Pegboards have come into wide general use as the best means of supporting tools for ready accessibility. However, many items cannot be easily supported from pegboard holders and accordingly many small tools are relegated to drawers, cases, boxes or heaped on shelves. Further, pegboard tool storage arrangements usually require considerable wall space and when limited space is available, many of the tools may be hung in an overlapping, jumbled arrangement.

Accordingly, there is a need for a compact tool holder that is capable of holding a considerable variety of tools in a stable array and which is easily accessible.

SUMMARY OF THE INVENTION

This invention provides a compact tool holder or storage device which is capable of holding a wide variety of hand tools in an organized, accessible and compact manner. The storage device is preferably constructed of a wire mesh body formed in an elongated boxlike configuration with tool hanger support assembly extending outward from a front face thereof which is intended to support larger tools. A top and bottom face of the tool holder includes complementary openings in the wire mesh to accommodate varying sizes of tools along the width thereof, with an upper opening in the wire mesh spacing providing a support for a tool placed in the holder and the bottom opening providing stability for a tool member extending therethrough. An open rear face of the wire mesh body is securable flat against a mounting surface for convenient accessibility to the tools stored therein. The device may be mounted in a more-or-less permanent manner with clamps or the like, or the mounting may be achieved in a temporary fashion with hooks or releasable mounting members. Herein, the entire collection of tools may be transported to various working areas as the need arises without removing individual tools from their normal supported position in the tool holder.

The tool hanger support assembly is carried on the front face of the wire mesh body with pivotal connections to permit the hanger assembly to be folded generally flat against the body for storage or shipping. Further, one end of the device is provided with a horizontal support plate which is secured to the holder body at a limited spaced relationship from the bottom mesh face. This plate provides a support for such tools as drill bits, punches, pencils and the like which would otherwise drop through the mesh openings. Tools supported in the holder body area are easily organized whereby similar tools may be arranged according to size and types for ease of locating specific tools as required.

It is, therefore, an object of the present invention to provide a tool holder capable of holding a wide variety of tools in a minimum space.

It is a further object of the present invention to provide a tool storage device in which similar tools of different sizes may be stored in compact rows, yet be easily accessible.

It is still another object of this invention to provide a compact lightweight tool rack which is constructed of a wire mesh in a boxlike configuration to support a wide variety of hand tools in an upright, spaced, accessible and stable manner and which can be easily moved in total from work location to work location.

Other objects, features and advantages of the present invention will be readily apparent from the following description of the preferred embodiment thereof taken in conjunction with the accompanying drawings, although variations and modifications may be effected without departing from the spirit and scope of the novel concepts of the disclosure.

BRIEF DESCRIPTION OF THE DRAWINGS

FIG. 1 is a perspective view of a compact hand tool storage device embodying features of this invention;

FIG. 2 is an enlarged side elevational view of the tool storage device shown in FIG. 1;

FIG. 3 is an enlarged transverse sectional view taken generally along the line III—III of FIG. 1; and FIG. 4 is an enlarged fragmentary plan view of the tool storage device.

DESCRIPTION OF THE PREFERRED EMBODIMENT

FIG. 1 illustrates a compact tool holder device 10 which is adapted to be mounted on a wall 11 or other vertical support surface which is convenient to a work area. The tool holder 10 includes a body 12 which is formed in an elongated boxlike configuration of a welded wire mesh 13 with an open back face 14. The wire mesh 13 encloses the body 12 on five sides with a top face 16 and a bottom face 17 serving to retain hand tools in a generally upright spaced manner. Both the top and bottom faces 16 and 17 are identical with regard to the spacing of the mesh cross wires. Preferably, the wire mesh spacing will differ over the width of the body 12 to accommodate varying tool sizes.

As best seen in FIG. 4, the mesh 13 is formed with a series of evenly spaced longitudinal wires 18 and a series of cross connecting wires 19. The wires 18 and 19 may be in the order of 14 gauge ($1\frac{1}{2}$ mm) for providing a suitable supporting strength. The cross wires 19 are preferably each welded to the longitudinal wires 18 at each intersection therebetween to form grid openings in the order of $1\frac{1}{2}$ cm (9/16") squares at the right side of the body 12 and forming grid openings in the order of $1\frac{1}{2}$ cm (9/16")×3 cm ($1\frac{1}{8}$") on the left side of the body.

The grid pattern of the wire mesh 13 extends outward from said open back face 14 along the top face 16 then downward along a front face 21 and thence backward along the bottom face 17 to said back face 14.

It has been found that most tool handles, such as used on screw drivers, files, wood chisels and the like, are sufficiently large to be supported by the above grid pattern. Further, the additional width of the grid pattern at the left of the body 12 can accommodate such items as wrenches, pliers, wire cutters and other such somewhat larger tools.

Thus, it will be seen that the openings as defined by the crossing wires 18 and 19 in the top face 16 are adapted to support certain portions of a hand tool and the openings in the bottom face provide a stabilizing influence on other portions of the tool. For example, the enlarged handle of a screw driver will rest on the top face wires and its blade which extends through the wire mesh 13 of the bottom face 17 serves to stabilize the screw driver blade to eliminate tilting. Thus, each tool is contained in a given pair of mesh opening (top and bottom faces) in an upright stabilized condition.

Now with particular reference to FIG. 3, there is shown a horizontally disposed support plate 22 which is secured below the bottom face 17 at the right-hand side of the body 12. The plate 22 is shown secured to the body 12 at a desired spacing from the bottom face 17 by means of a pair of spacer members 23. Alternatively, the spacer members may be formed integrally with the support plate 22. The plate 22 cooperates with the mesh openings thereabove to support tool members such as drill bits, punches, reamers, pencils and the like, which have no handles or projections which can be supported from the wire mesh of the top face 16. Thus, these tools are supported on their ends in an organized accessible compact array.

The longitudinal wires 18 of the body 12 extend from the front face 21 around the sides 25 and terminate in the area of the back face 14, while the longitudinal wires 18 of the top and bottom faces terminate short of the sides 25. Short length, spaced vertical cross wires 26 are welded at the intersections with the wires 18 extending rearward from the front face 21 to define a mesh at the side faces 25 of the body 12. The mesh sides 25, while serving primarily to rigidify the tool holder body 12, may also be used to support items which may be hooked onto the mesh sides. Further, gaps 28 formed in the body adjacent each of the sides 25, may be utilized for supporting such items as steel squares, calipers or like tools.

As best seen in FIGS. 1 and 3, the open back face 14 of the body 12 is framed with a rectangular shaped mounting rod 29 which may be in the order of 5 gauge (5 mm) to provide suitable mounting strength. The mounting rod 29 is welded to each of the rearward terminating ends of the grid forming wires 18 and 19.

Mountings clips or clamps 30 are provided to secure the tool holders 10 to the wall 11 in a more-or-less permanent manner. The clips 30 are shown in FIG. 3 as attached to the mounting rod 29 and screwed to the wall 11 to support the tool holder device 10 in a horizontal orientation with the mounting rod 29 seated flat against the wall for stability. However, if preferred, the tool holder device 10 may be supported from the wall 11 in a temporary manner (see FIG. 2) in which a screw head 32 may be used as a hanger to retain the mounting rod 29 against the wall 11. Herein, the entire tool holder 10 loaded with tools may be easily picked up and moved to a second location and hung from a second set of supporting screws 32 or other suitable hanger means.

Thus, it will be appreciated that an entire tool collection, contained in the tool holder 10, may be moved from a basement workshop area to a garage without removing the tools from a pegboard supporting arrangement or tool chest. Further, if the tools are removed from their supporting means, they are generally carried in a mixed, disorganized group to the required place of use and after the tools are no longer needed, they must be returned to the place from which they were originally taken. The present invention eliminates this problem and provides an organized storage place when working in areas remote from a workshop area.

Although many types of tools can be compactly and orderly stored in the body 12 portion of the tool holder device 10, some large tools such as tin snips, wrenches, shears and the like may not be conveniently supported in the mesh openings. Accordingly, a tool hanger assembly 35 is provided which is pivotally carried on one of the longitudinal wires 18 extending along the front face 21 as best seen in FIGS. 1 and 2. The assembly 35 comprises an elongated bent rod 36 extending along the length of the body 12 and carries a series of hook-like members 37 which are welded thereto. The hook members 37 extend outwardly from the front face 21 of the body 12 and are secured to the rod 36 at various spaced intervals to accommodate a variety of tool sizes. As shown in FIG. 2, the hanger assembly 35 may be pivoted to a broken line position, which is generally flat against the body 12 for shipping or storing the tool holder device 10.

It has been found that a holder of approximately 24" (61 cm) by 3½" (9 cm) can accommodate from 100 to 150 tools in an orderly array, yet providing ready access to each of the tools stored therein. Obviously, other body proportion, mesh spacing and wire gauge dimensions may be equally well-suited for tool holder devices of the present invention and it should be understood that I wish to embody within the scope of the patent warranted hereon all such modifications as reasonably and properly come within the scope of my contribution to the art.

I claim as my invention:

1. A tool holder device for storing hand tools in an organized, accessible and compact manner comprising:

an elongated body means having longitudinal top and bottom faces thereon with each of said faces being formed of a grating having tool receiving openings therein whereby said top face grating is adapted to support certain hand tools in an upright pendent orientation and whereby said bottom face grating is adapted to stabilize depending portions of said hand tools extending through said bottom face openings;

a mounting means for securing said elongated body to a mounting surface;

a longitudinal support plate secured to said body and underlying a portion of said bottom face being adapted to support on end certain tool members which are not supportable by said top face grating in a pendent orientation wherein both top and bottom face gratings serve to stabilize portions of said tool members extending through said top and bottom face openings; and a tool hanger means pivotally carried on said body means and having a plurality of tool supporting hooks adapted to extend outwardly of said body means when said tool hanger is placed in a tool supporting position and said plurality of tool supporting hooks are adapted to fold generally flat against said body means when said tool hanger means is pivoted to a non-tool supporting position.

2. The tool holder device according to claim 1, in which said top face comprises a mesh with a plurality of openings therein being of graduated size to accommodate tools of different configuration.

3. The tool holder device according to claim 1, wherein said grating of said top and bottom faces comprise a wire mesh which mesh defines said tool receiving openings, said wire mesh including at least two sizes of tool receiving openings therein and with said top and bottom face tool receiving openings being vertically aligned.

4. The tool holder device according to claim 1, wherein said top and bottom faces comprise a wire mesh and said body means includes a wire mesh front face and a pair of wire mesh side faces.

5. The tool holder device according to claim 4, wherein said body means further includes an open back having a mounting rod encircling said open back and attached to said top, bottom and side faces to define a rear mounting face for abutting against said longitudinal mounting surface when said elongated body means is secured to said mounting surface.

6. The tool holder device according to claim 5, wherein said mounting means comprises a temporary connection to accommodate moving said tool holder device from work place to work place.

7. A compact tool holder for storing hand tools in an organized, accessible and compact manner including:

an elongated box-shaped body having a wire mesh top, bottom, front and sides thereon, said wire mesh top and bottom having tool receiving openings therein whereby certain hand tools are supported by said wire mesh top in an upright pendent orientation and whereby said wire mesh bottom stabilizes depending portions of said hand tools extending through said wire mesh bottom;

a mounting means for securing said elongate box-shaped body to a mounting surface;

a support plate secured to said body to underlie a portion of said wire mesh bottom at a spaced relationship thereto to support on end certain tool members which are not supportable by said wire mesh top wherein both said wire mesh top and bottom stabilize portions of said tool members which extend through said tool receiving openings; and a tool hanger carried on said wire mesh front and having a plurality of tool supporting hooks for hanging a plurality of tools thereon.

8. The tool holder device according to claim 7, wherein said mounting means comprises a temporary connection to accommodate moving said tool holder device from work place to work place.

* * * * *